US005708447A

United States Patent [19]

Kammer et al.

[11] Patent Number: 5,708,447

[45] Date of Patent: Jan. 13, 1998

[54] ANTENNA HAVING A PARABOLIC REFLECTOR

[75] Inventors: Michael Kammer, Bad Nenndorf; Hans-Peter Quade, Hanover; Karl Heinz Reimann, Langenhagen, all of Germany

[73] Assignee: Alcatel Kabel AG & Co., Hanover, Germany

[21] Appl. No.: 567,782

[22] Filed: Dec. 5, 1995

[30] Foreign Application Priority Data

Dec. 6, 1994 [DE] Germany ..... 9419493 U

[51] Int. Cl.[6] ..... H01Q 19/12

[52] U.S. Cl. ..... 345/840; 343/912; 333/254

[58] Field of Search ..... 343/840, 912, 343/884, 878, 892; 333/250, 254, 255, 21 R, 21 A; H01Q 19/12

[56] References Cited

U.S. PATENT DOCUMENTS 5,508,712 4/1996 Tom et al. ..... 343/840

*Primary Examiner*—Hoanganh T. Le

*Attorney, Agent, or Firm*—Ware, Fressola, Van Der Sluys & Adolphson LLP

[57] ABSTRACT

An antenna includes a parabolic reflector and a supply line attached thereto. The supply line includes two rectangular electromagnetic (waveguides) that are essentially parallel to each other. A tube-shaped exciter is common to the (waveguides) and is located at open ends of the waveguides. A back side of the reflector has a mechanically stable receptacle, which is used to attach the reflector to a support. The receptacle includes a metal ring with an L-shaped cross section in an opening that corresponds to a central opening in the reflector. The ring has a cylindrical area and, at a right angle to the cylindrical area, a base area that extends toward the inside of the ring. In the installed position, the cylindrical area of the ring penetrates and is centered in the opening of the reflector. A holding plate, which firmly surrounds and supports both waveguides, fits precisely into the ring and is attached to the ring in removable form when mounted.

20 Claims, 3 Drawing Sheets

ANTENNA HAVING A PARABOLIC REFLECTOR

BACKGROUND OF THE INVENTION

1. Technical Field

The present invention relates to an antenna, and more particularly to an antenna with a parabolic reflector.

2. Description of the Prior Art

Antennas with parabolic reflectors are used for example for directional radio and satellite transmissions, or for radio location. Such antennas can be used for direct illumination of the reflector, or also to illuminate the reflector by means of a subreflector (Casse grain principle). This "illumination" encompasses both transmission directions of the electromagnetic waves, i.e., waves to be reflected as well as waves to be received. Exciters are used for the illumination and are located at an open end of a supply line. "Exciters" can be polarization cross-over networks for example, for conducting two or more electromagnetic waves.

In a known antenna described in U.S. Pat. No. 3,864,688, a holding plate contains two sleeve-shaped cut outs for receiving two hollow conductors (also known as waveguides or supply lines), where each opening receives one waveguides. Details about the attachment of the holding plate to the reflector cannot be found in the patent description. It has been found that this known construction requires a relatively large effort for adjustment of the optimum position of the exciter located at the end of the waveguides, since the waveguides and the exciter must be held so that the holding plate can easily rotate inside the reflector, without tilting. This applies both to the initial installation of the supply line and to any subsequent change.

SUMMARY OF THE INVENTION

An object of the invention is to provide an improved antenna having a parabolic reflector wherein the supply line can easily be mounted and adjusted without tilting the holding plate.

It has been found that the foregoing objects can be readily attained by providing a mechanically stable receptacle located on a back side of an antenna reflector, the receptacle being configured for attachment to a support. A metal ring having an L-shaped cross section is attached to an opening of the receptacle that corresponds to an opening in the reflector, wherein the ring has a cylindrical area and a base area positioned at right angles with respect to one another. The base area extends to the inside of the ring and, when the ring is installed in the receptacle, its cylindrical area is centered in the opening of the reflector. A holding plate is provided, which fits exactly into the ring and can be easily removed therefrom.

A significant advantage of the present invention is that when the holding plate and the ring are attached to the receptacle they fit precisely with each other, so that the holding plate can be inserted into the ring without any adjusting operation. An additional advantage of the invention is that since the ring is centered with respect to the reflector when it is attached to the receptacle, the supply line comprising both the waveguides and the exciter is automatically in the correct position. This correct position of the supply line is achieved if the holding plate, which was previously precisely attached to the supply line, is inserted into the ring and affixed thereto, e.g., attached with screws. The ring has an L-shaped cross section with a cylindrical area and a base area that are at right angles with respect to one another. When inserted into the ring, the holding plate passes through the cylindrical area of the ring until it contacts the base area. The holding plate is therefore unable to tilt during installation into the ring.

The foregoing and other objects, features and advantages of the present invention will be fully understood when reference is made to the following detailed description thereof taken in conjunction with the accompanying drawings.

BRIEF DESCRIPTIONS OF THE DRAWINGS

DETAILED DESCRIPTION OF THE INVENTION

Figure 1:
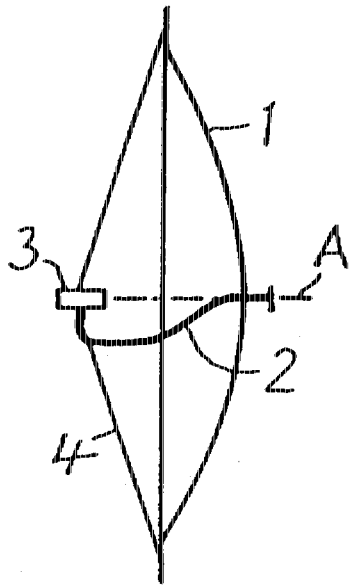
FIG. 1 is a schematic diagram of an antenna according to the invention.

Referring to FIG. 1, an antenna is shown with a parabolic reflector 1 and a supply line 2 affixed thereto. The supply line 2 passes through the center of the reflector 1, which has an opening to that effect that can be seen in FIG. 2. The supply line 2 is bent in such a way, that the opening of an exciter 3 located at the supply line open end is approximately positioned in the focal point of the reflector 1. Clamping elements 4, that are attached to the reflector 1, can be used to additionally hold the supply line 2 or the exciter 3. For example, four clamping elements 4 offset by 90° each can be used.

Figure 3:
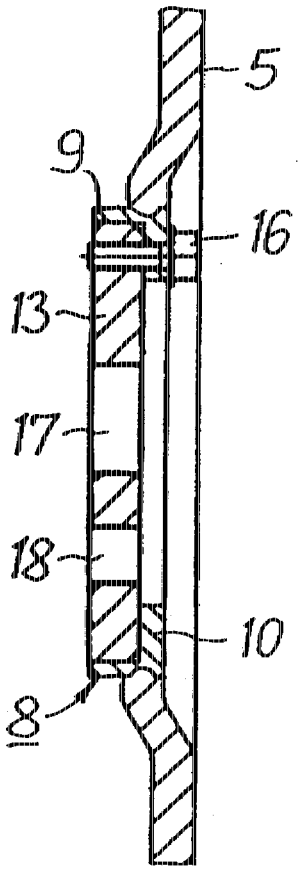
FIG. 3 is a cross-sectional view of a receptacle, ring and holding plate of the antenna of FIG. 1.
Figure 2:
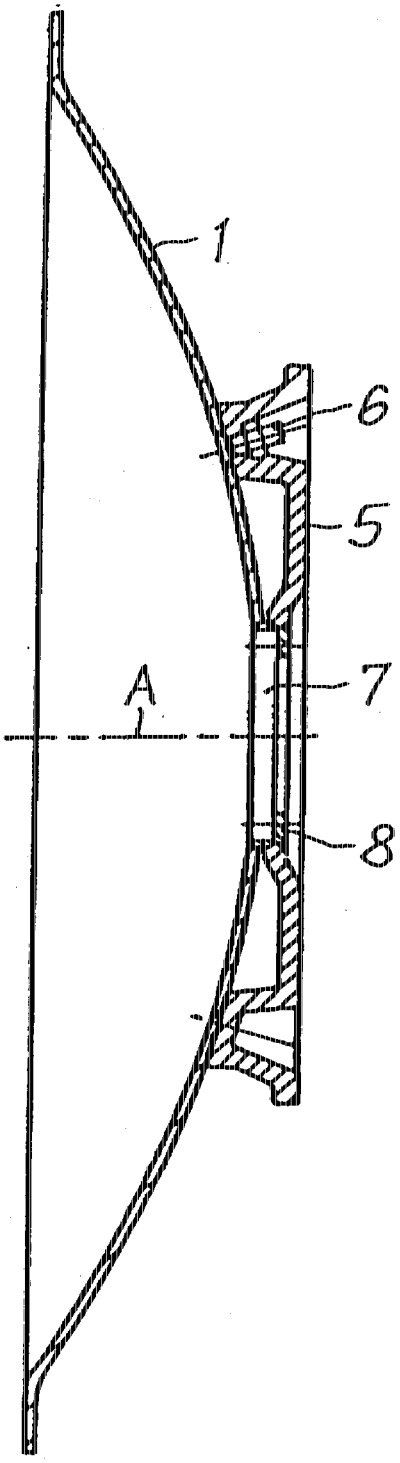
FIG. 2 is an enlarged cross-sectional view of the antenna of FIG. 1.

Referring also in FIG. 2, to attach the reflector 1 to a support, for example to a mast, a mechanically stable receptacle 5 is affixed to a rear side of the reflector 1. The receptacle 5 can be secured to the reflector 1 with screws 6, for example, of which only one is illustrated in FIG. 2. However, a number of screws 6 may be provided to securely attach the receptacle 5 to the reflector 1. The receptacle 5 has a central opening 7 which corresponds to the opening in reflector 1, in which the supply line 2 can be attached. A metal ring 8 with an L-shaped cross section is securely affixed to the opening 7 of receptacle 5. As shown in FIG. 3, the ring 8 has a cylindrical area 9 and a base area 10 extending inward from the cylindrical area at a right angle thereto. Referring again to FIG. 2, in the installed position, the cylindrical area 9 of ring 8 extends into the opening of reflector 1. When mounted, the ring 8 is centrally located with respect to axis A (FIGS. 1 and 2) of reflector 1.

Figure 6:
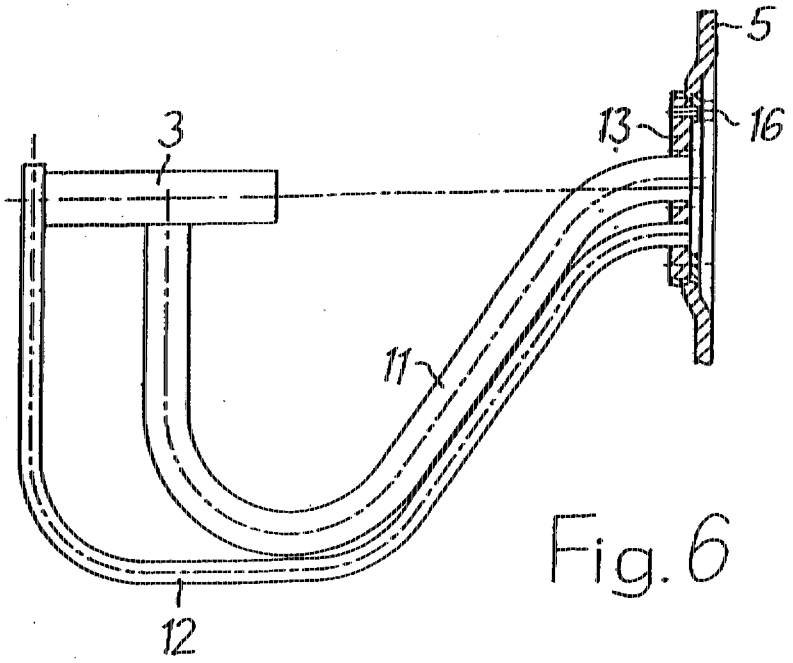
FIG. 6 is a cross-sectional view showing the arrangement of a supply line attached to the holding plate of FIG. 3.
Figure 7:
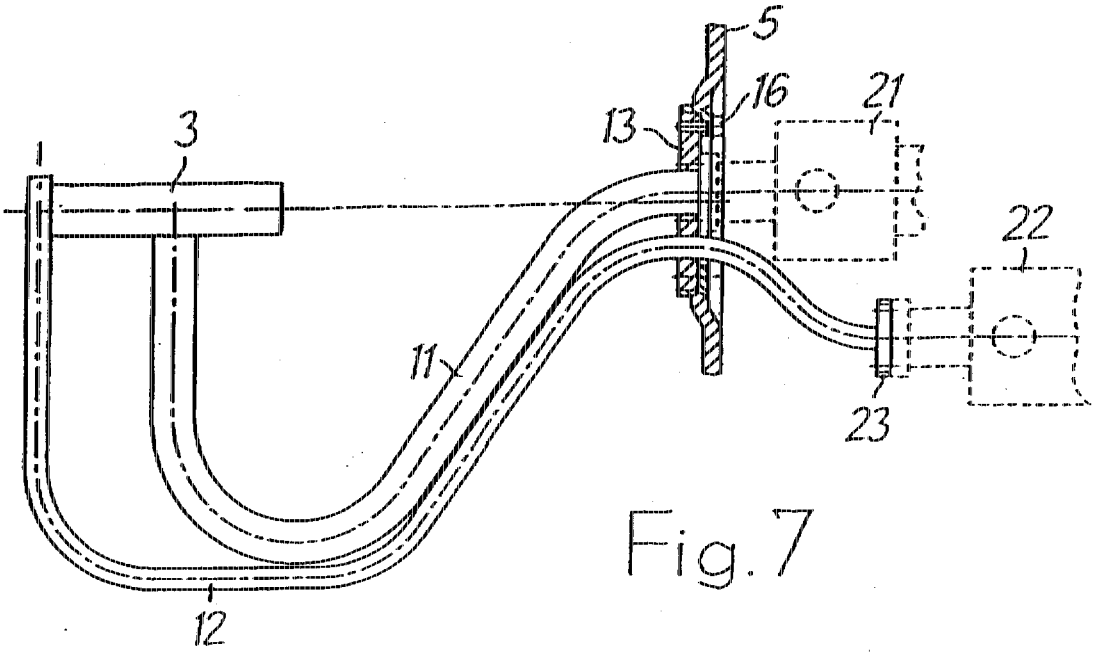
FIG. 7 is a cross-sectional view, partially in phantom, showing a second arrangement of a supply line attached to the holding plate of FIG. 3.

Referring to FIGS. 6 and 7, the supply line 2 comprises two rectangular waveguides 11 and 12. An exciter 3 is located at the end of the waveguides 11, 12. An opening of the exciter 3 is approximately positioned in the focal point of the parabolic reflector 1. The two waveguides 11 and 12 are attached to a holding plate 13, which in turn secures them to the reflector 1.

Figure 4:
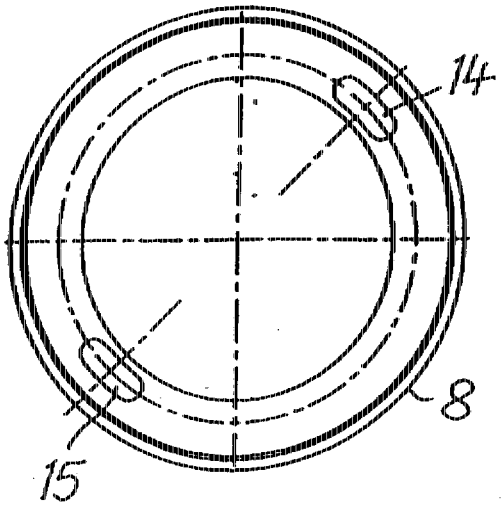
FIG. 4 is a top view of the ring of FIG. 3.
Figure 5:
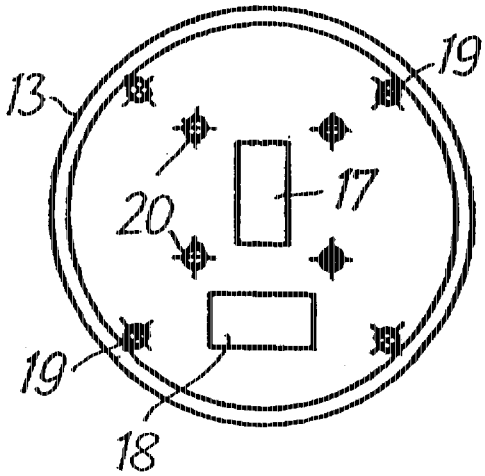
FIG. 5 is a top view of the holding plate of FIG. 3.

FIGS. 3, 4 and 5 illustrate an enlargement of the ring 8 and the holding plate 13. The holding plate 13 and ring 8 are designed so that the holding plate 13 fits very accurately into the ring 8. In the illustrated configuration example, the base area 10 of ring 8 has two elongated through going apertures 14 and 15, which extend in the peripheral direction and are peripherally offset with respect to each other. The apertures 14, 15 preferably oppose each other diametrically. Even more than two elongated apertures can be peripherally offset with respect to each other in ring 8. It is basically enough if only passage holes for receiving screws 16 (FIG. 3) are provided in the base area 10 of ring 8, whereby the holding plate 13 is attached to the ring 8 and secured thereto by the screws 16. However, the elongated apertures 14 and 15 provide the possibility of performing a fine adjustment of the supply line 2 after the holding plate 13 has been mounted to the ring 8. This allows the holding plate 13 to be rotated, for example, a rotation of a maximum angle of 15°, depending on the length of the elongated holes 14 and 15, if the screws 16 have not yet been tightened.

The holding plate 13 contains two openings 17 and 18, into which the two waveguides 11 and 12 (FIGS. 6 and 7) are placed. A peripheral phase has been provided on the attachment side of the ring 8, which facilitates the insertion of the holding plate 13 into the ring 8. In the illustrated configuration example, the holding plate 13 contains four peripherally offset tapped apertures 19, of which only two opposite apertures are needed to coincide with the elongated holes 14 and 15 of ring 8. However, four tapped apertures 19 are provided so that the supply line 2 can potentially be rotated 90° when inserted into the ring 8. Additional, tapped apertures 20 in the holding plate 13 serve to attach other conducting parts, which are connected to the two waveguides 11 and 12, in order to complete the transmission path. Such parts are for example the fittings 21 and 22 shown in phantom in FIG. 7.

Referring to FIGS. 6 and 7, in a preferred configuration, the ring 8 is made of special steel. Preferably, the ring 8 is already solidly connected to receptacle 5 during the manufacture. It is particularly useful to solidly connect the ring and receptacle so that the ring cannot be lost. If the receptacle 5 is made of a cast material, for example iron or aluminum, the ring 8 can be simultaneously cast into the receptacle 5. Manufacturing the ring 8 of special steel is advantageous for protecting both of the waveguides 11 and 12 against corrosion, since they are made of electrically conducting material such as copper or brass, for example. The "special steel" material is an "intermediate layer" for protection against corrosion between the different materials of the holding plate 13 made for example of brass on the one hand, and the receptacle 5 on the other.

In antennas with small size hollow conductors 11 and 12, it may be sufficient if the waveguides ends are held by the holding plate 13 as shown in FIG. 6. In that case, front areas of the waveguides 11, 12 are flush with the outward facing area of the holding plate 13. A surface of the waveguide front area is large enough to connect fittings for the continuation of the transmission path. As shown in FIG. 7, if the waveguides 11 and 12 are of larger size, the holding plate 13 surface for the connection of two fittings could possibly be too small. In such a case, one of the waveguides 12 may be extended so that it protrudes beyond the holding plate 13. In addition, the one waveguide 12 is bent radially outward with respect to the holding plate 13. A fitting 21 for the other waveguide 11 can then be affixed to the holding plate 13 in an unimpeded manner. At its free end, the one waveguide 12 has a flange 23 to which the fitting 22 can be attached.

The precise manufacture of the ring 8 and the correspondingly precise manufacture of holding plate 13 produce an attachment device, which can be used for supply lines 2 with two equal waveguides each, whose dimensions can differ.

Although the invention has been described with respect to exemplary embodiments thereof, it will be understood that the foregoing and various other additions and omissions may be made therein and thereto without departing from the spirit and scope of the present invention.

What is claimed:

1. An antenna comprising:

a parabolic reflector having a central opening;

a supply line attached to said parabolic reflector, said supply line including two rectangular, essentially parallel electromagnetic waveguides and a tube-shaped exciter affixed to open ends of both waveguides;

a holding plate located in said central opening of said reflector, said holding plate securely surrounding and supporting both of said waveguides for attachment to said parabolic reflector;

a mechanically stable receptacle mounted on a back side of said reflector, said receptacle being used to attach the reflector to a support, said receptacle having an opening corresponding to said reflector central opening;

a metal ring having an L-shaped cross section affixed to said receptacle opening, said ring having a cylindrical area and a base area at right angles with respect to one another, said base area pointing to the inside of the ring, said receptacle and said ring being positioned within said reflector central opening such that said ring is centered in said reflector central opening; and wherein said holding plate fits precisely into the said ring for thereby locating said holding plate in said central opening of said reflector and wherein said holding plate can be removed from said ring.

2. An antenna as claimed in claim 1, further comprising screws for attaching said holding plate and said ring.

3. An antenna as claimed in claim 2 wherein said base area of said ring includes at least two elongated apertures which extend in the peripheral direction and are offset with respect to each other for passage of said screws.

4. An antenna as claimed in claim 3 wherein said two elongated apertures diametrically oppose each other in said base area of said ring.

5. An antenna as claimed in claim 4, wherein said ring is made of special steel.

6. An antenna as claimed in claim 5 wherein said ring is part of said receptacle and is solidly formed with it during manufacture.

7. An antenna as claimed in claim 6 wherein said holding plate is made of brass.

8. An antenna as claimed in claims 7 wherein a front surfaces of said two waveguides are flush with an outward facing surface of said holding plate.

9. An antenna as claimed in claim 8, wherein attachment elements are affixed to said holding plate for the accurate positioning of conducting parts.

10. An antenna as claimed in claim 7 wherein a front surface of one of said waveguides is flush with an outward facing surface of said holding plate, and wherein another of said waveguides extends beyond said holding plate and is bent radially outward with respect to said holding plate.

11. An antenna as claimed in claim 10, wherein attachment elements are affixed to said holding plate for the accurate positioning of conducting parts.

12. An antenna as claimed in claim 1, wherein said ring is made of special steel.

13. An antenna as claimed in claim 12 wherein said ring is part of said receptacle and is solidly formed with it during manufacture.

14. An antenna as claimed in claim 13 wherein said holding plate is made of brass.

15. An antenna as claimed in claims 1 wherein a front surfaces of said two waveguides are flush with an outward facing surface of said holding plate.

16. An antenna as claimed in claim 15, wherein attachment elements are affixed to said holding plate for the accurate positioning of conducting parts.

17. An antenna as claimed in claim 1 wherein a front surface of one of said waveguides is flush with an outward facing surface of said holding plate, and wherein another of said waveguides extends beyond said holding plate and is bent radially outward with respect to said holding plate.

18. An antenna as claimed in claim 17, wherein attachment elements are affixed to said holding plate for the accurate positioning of conducting parts.

19. An antenna as claimed in claim 1 wherein said ring is part of said receptacle and is solidly formed with it during manufacture.

20. An antenna as claimed in claim 1 wherein said holding plate is made of brass.

* * * * *